US005142749A

United States Patent [19]

Biller

[11] Patent Number: 5,142,749

[45] Date of Patent: Sep. 1, 1992

[54] BUCKLE FOR VEHICLE SAFETY BELTS

[75] Inventor: Dieter Biller, Alfdorf-Brech, Fed. Rep. of Germany

[73] Assignee: TRW Repa GmbH, Alfdorf, Fed. Rep. of Germany

[21] Appl. No.: 849,473

[22] Filed: Mar. 11, 1992

[30] Foreign Application Priority Data

Mar. 22, 1991 [DE] Fed. Rep. of Germany ... 9103556[U]

[51] Int. Cl.[5] ..... A44B 11/25

[52] U.S. Cl. ..... 24/636; 24/637

[58] Field of Search ..... 24/636, 637, 638, 633, 24/634, 646

[56] References Cited

U.S. PATENT DOCUMENTS 4,611,369 9/1986 Wier ..... 24/636
4,642,857 2/1987 Ono ..... 24/637
4,733,443 3/1988 Tolfsen ..... 24/637
4,928,366 5/1990 Ballet ..... 24/636

*Primary Examiner*—Victor N. Sakran
*Attorney, Agent, or Firm*—Tarolli, Sundheim & Covell

[57] ABSTRACT

A buckle for vehicle safety belt systems equipped with a belt pretensioner engaging on the buckle is provided. The buckle has a release button with a cutout wherein a pushbutton is slidably received. The release button carries a two-armed blocking lever pivotally mounted thereon. In normal use, the blocking lever, when the pushbutton is depressed, is pivoted away from a stop member on the buckle housing to permit the release button to be moved until the buckle opens. When after activation of the belt pretensioner the buckle has reached the end of its stroke the release button tends to continue its movement, but the two-armed lever will hit on the stop member to prevent the release button from moving towards its release position.

5 Claims, 1 Drawing Sheet

BUCKLE FOR VEHICLE SAFETY BELTS

The present invention relates to a buckle for vehicle safety belts comprising a loadbearing housing and a release button which is displaceably guided therein, is biased by spring force into a rest position and has an actuating face.

For use in safety belt systems provided with a belt pretensioner engaging the buckle the latter must be secured against unintentional opening at the end of the pretensioning stroke. When activated, the belt pretensioner moves the buckle in the direction towards the vehicle floor until a stop is reached. On reaching the stop the movement of the buckle is abruptly stopped. However, due to the inertial mass the functional parts of the buckle tend to continue their movement. This also applies to the release button, the inertia-induced further movement of which would cause opening of the buckle.

Various steps have already been proposed for preventing inertia-induced opening of the buckle at the end of the pretensioning stroke. However, difficulties are encountered in the integration of these steps into existing buckle constructions.

The present invention provides a buckle for vehicle safety belts which is safe against unintentional opening and does not differ from conventional buckle constructions as regards the design principle, constructional form and overall size. According to the invention, a buckle is provided wherein the actuating face of the release button is formed on a pushbutton which is integrated into the release button and guided displaceably in the latter over a limited travel distance in the displacement direction of the release button. The release button is biased by spring force into a rest position. On the release button a two-armed blocking lever is pivotally mounted. The first arm of the blocking lever bears on the pushbutton when the pushbutton is in its rest position, and the second arm of the blocking lever lies opposite a stop member of the loadbearing housing. When the pushbutton is depressed with respect to the release button, the pushbutton is pivoted away from the stop member and moved past the stop member in the displacement direction of the release button along with the latter. The spring force biasing the blocking lever into its rest position is smaller than the spring force biasing the release button into its rest position. That the center of gravity of the blocking lever lies on the outer side of a plane running through the pivot axis of the blocking lever and parallel to the longitudinal direction of the buckle.

For opening the buckle, in the usual manner the actuating face is pressed but in contrast to the conventional buckle configuration not on the release button but on the pushbutton integrated therein. By depressing the pushbutton, the two-arm lever is pivoted until the second lever arm thereof is pivoted away from the stop member of the buckle housing. Only thereafter is the release button moved as well on further depression of the pushbutton until finally said release button in conventional manner releases the locking bar holding the insert tongue in the buckle.

When after activation of the belt pretensioner the buckle has reached the end of its displacement travel and due to its inertial mass the release button tends to continue its movement, the two-armed lever simultaneously tends to execute a pivot movement in a sense such that its second lever arm remains opposite the stop member of the buckle housing. The further movement of the release button is prevented by the second lever arm striking the stop member of the buckle housing.

To transform an existing buckle design into one suitable for use with a belt pretensioner in accordance with the principles of the invention only minor modifications are necessary: The release button is provided in two parts by cutting away the region of the actuating face and displaceably mounting a separate pushbutton in the cutout region; furthermore, in the interior of the release button the two-arm lever is pivotally mounted on a pin. Thus, these modifications involve essentially only the release button, a component which is made from plastic and can thus easily be replaced by another component.

Further features and advantages of the invention will be apparent from the following description and the drawings, to which reference is made and in which.

Figure 1:
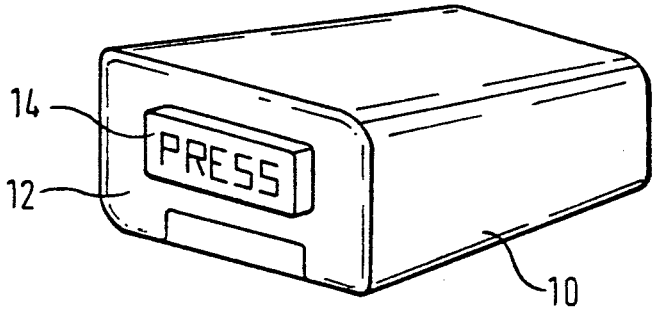
FIG. 1 shows a schematic perspective view of the buckle for vehicle safety belts.

A buckle for vehicle safety belts consists of a loadbearing housing, functional parts mounted thereon and a cover shell of plastic surrounding said elements and imparting to the buckle the form shown in FIG. 1. At the end side of the cover shell 10 the actuating face of a release button 12 is located. A pushbutton 14 projects 2 to 3 mm out of said actuating face of the release button 12. As apparent in FIGS. 2 and 3, the release button 12 comprises a cutout 16 in which the pushbutton 14 is displaceably guided. The pushbutton 14 is generally cap-shaped and has two flanges **14*a*, 14*b* at its longitudinal ends which come into engagement with the inner side of the release button 12**.

A stirrup member 18, the end face of which lies opposite the pushbutton 14, forms part of the loadbearing buckle housing, which is conventionally constructed and will therefore not be described in detail. A two-armed angled blocking lever 20 is pivotally mounted on a pin 22 at the open inner side of the release button 12. The first lever arm **20*a* engages into the cavity of the pushbutton 14 and bears with its free end on the inner side of the pushbutton. The second lever arm 20*b* is disposed opposite the end face of the stirrup 18 forming a stop member and is biased by a pressure spring 24 bearing on the release button 12 in such a sense that the first lever arm 20*a* is held in engagement with the inner side of the pushbutton 14. The center S of gravity of the blocking lever 20 lies in the second lever arm 20*b* on the outer side of a plane which passes through the axis of the bearing pin 22** and is parallel to the longitudinal direction of the buckle.

Figure 2:
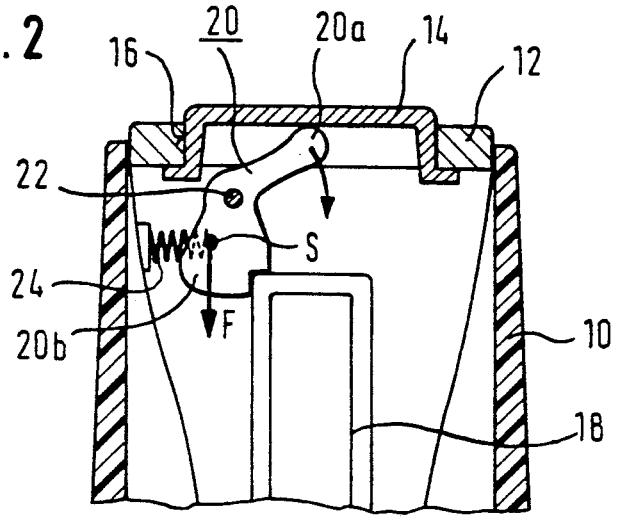
FIG. 2 is a partial view of the buckle shown in longitudinal section.
Figure 3:
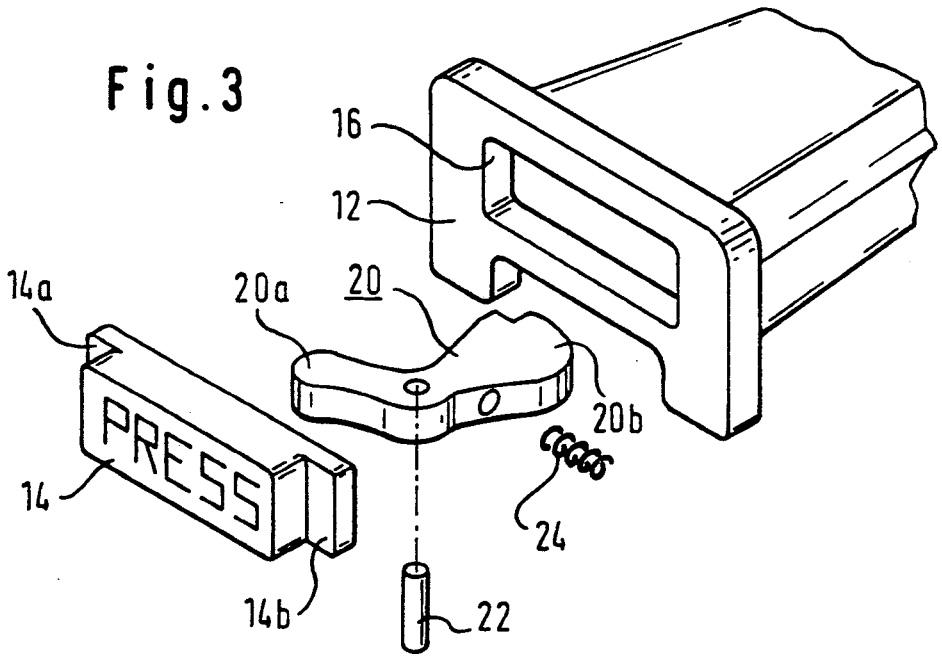
FIG. 3 is an exploded view of the release button of the buckle.

By a conventional return spring, not shown in the drawings, the release button 12 is biased into the rest position shown in FIG. 2.

To actuate the release button 12 the pushbutton 14 is first depressed. The two-arm blocking lever 20 is pivoted clockwise in FIG. 2, its second lever arm **20*b* thereby being moved adjacent the end face of the stirrup 18. Only then is it possible to depress the release button 12 via the pushbutton 14** to open the buckle.

On activation of the belt pretensioner, which engages the buckle directly and shifts the latter in the direction towards the vehicle floor, after travelling for example through 10 cm, the buckle strikes a stop and is abruptly decelerated. Due to their inertial mass, the release button 12 and the parts mounted thereon tend to continue the movement. At the center S of gravity of the blocking lever 20 an inertial force F directed in the displacement direction is active. Since the center S of gravity lies on the outer side of the buckle with respect to the pivot axis of the blocking lever, said lever 20 tends to execute a pivoting movement anticlockwise but is prevented from doing so because the free end of the first lever arm 20*a* bears on the inner side of the pushbutton 14. The blocking lever 20 thus remains in its rest position shown in FIG. 2. In this position however the free end of the second lever arm 20*b* lies opposite the end face of the stirrup member 18; on a slight movement of the release button 12 out of its rest position the second end of the lever arm 20*b* strikes against the stirrup member 18 which forms a stop member and prevents further movement of the release button.

I claim:

1. A buckle for vehicle safety belts comprising a load-bearing housing and a release button which is displaceably guided in said housing, said release button being biased by spring force into a rest position and comprising an actuating face, said actuating face of the release button being formed on a pushbutton which is integrated into said release button and guided displaceably in said release button over a limited travel distance in the displacement direction of the release button and is biased by spring force into a rest position, said release button carrying a two-armed blocking lever pivotally mounted thereon around a pivot axis and having a first lever arm which bears on said pushbutton and a second lever arm which, when said pushbutton (14) is in said rest position, lies opposite a stop member of the load-bearing housing, said second arm of the blocking lever, when the pushbutton is depressed with respect to the release button, being pivoted away from said stop member to be moved past said stop member, and the spring force biasing the blocking lever into its rest position being smaller than the spring force biasing the release button into its rest position, the center of gravity of said blocking lever lying on the outer side of a plane running through said pivot axis of the blocking lever and parallel to a longitudinal direction of the buckle.

2. The buckle according to claim 1, wherein said pushbutton has an actuating face which, in the rest position of the pushbutton, projects out of the release button.

3. The buckle according to claim 2, wherein said actuating face of the pushbutton, in its position depressed with respect to the release button, lies approximately flush with the outer surface of said release button.

4. The buckle according to claim 1, wherein said release button has a recess wherein said pushbutton is slidably received, said pushbutton comprising at least one flange which in its rest position bears on the inner side of an edge of said recess.

5. The buckle according to claim 1, wherein said second arm of the blocking lever bears via a pressure spring on the release button.

* * * * *